US008769873B2

(12) United States Patent
Feng et al.

(10) Patent No.: US 8,769,873 B2
(45) Date of Patent: Jul. 8, 2014

(54) CASEMENT WINDOW WITH MULTI-ANGLE LOCKING WINDOW SASH

(75) Inventors: Lin Feng, Shenzhen (CN); Hoichi Leung, Hong Kong (CN); Lok Shun Leung, Hong Kong (CN)

(73) Assignee: Shenzhen Qichuangmei Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 13/643,989

(22) PCT Filed: Apr. 26, 2010

(86) PCT No.: PCT/CN2010/000571

§ 371 (c)(1),
(2), (4) Date: Dec. 26, 2012

(87) PCT Pub. No.: WO2011/134100

PCT Pub. Date: Nov. 3, 2011

(65) Prior Publication Data

US 2013/0104458 A1 May 2, 2013

(51) Int. Cl.
*E05D 7/06* (2006.01)

(52) U.S. Cl.
USPC ..... 49/246; 49/248; 49/250; 49/252; 49/260

(58) Field of Classification Search
USPC ..... 49/246–252, 260
See application file for complete search history.

(56) References Cited

U.S. PATENT DOCUMENTS

| | | | | | |
|---|---|---|---|---|---|
| 2,585,122 | A * | 2/1952 | Hartman | 49/343 |
| 2,778,630 | A * | 1/1957 | Pearson | 49/82.1 |
| 4,253,276 | A * | 3/1981 | Peterson et al. | 49/249 |
| 4,497,135 | A * | 2/1985 | Vetter | 49/280 |
| 4,689,852 | A * | 9/1987 | Buckley | 16/341 |
| 4,887,392 | A * | 12/1989 | Lense | 49/300 |
| 5,839,229 | A * | 11/1998 | Briggs et al. | 49/246 |
| 5,898,977 | A * | 5/1999 | Muir | 16/363 |
| 6,672,010 | B1 * | 1/2004 | Gledhill et al. | 49/341 |
| 6,915,608 | B2 * | 7/2005 | Labarre | 49/140 |
| 6,928,697 | B2 * | 8/2005 | Brain et al. | 16/193 |
| 7,013,604 | B1 * | 3/2006 | Moody et al. | 49/341 |
| 7,047,600 | B2 * | 5/2006 | Muir | 16/366 |
| 8,141,295 | B2 * | 3/2012 | Carrier | 49/249 |
| 8,365,470 | B1 * | 2/2013 | Campbell et al. | 49/343 |
| 8,434,265 | B1 * | 5/2013 | Campbell et al. | 49/250 |
| 2003/0029091 | A1 * | 2/2003 | Renz et al. | 49/246 |
| 2003/0110701 | A1 * | 6/2003 | Dawson | 49/246 |
| 2007/0144072 | A1 * | 6/2007 | Hansel et al. | 49/246 |

* cited by examiner

*Primary Examiner* — Katherine Mitchell
*Assistant Examiner* — Justin Rephann

(57) ABSTRACT

A casement window with multi-angle window sash includes a window frame (2) and a window sash (5). The window sash (5) is connected with the window frame (2) by a window hinge mechanical structure and a locking mechanism (7), wherein the mechanical structure of the window hinge includes a quadrilateral link mechanism (4), a movable sliding block (10), a gear (9), and a hinge seat (3); the locking mechanism (7) includes a screw rod (75) with an axial plane (78) and a thread (77). The screw rod (75) realizes the locking of the window sash (5) by meshing the thread (77) with the gear (9), and realizes the opening and closing of the window sash (5) by the axial plane (78). The casement window is simple in structure, low in cost, convenient to install and use, and provides high safety.

6 Claims, 6 Drawing Sheets

CASEMENT WINDOW WITH MULTI-ANGLE LOCKING WINDOW SASH

CROSS REFERENCE OF RELATED APPLICATION

This is a U.S. National Stage under 35 U.S.C 371 of the International Application PCT/CN2010/000571, filed Apr. 26, 2010.

BACKGROUND OF THE PRESENT INVENTION

1. Field of Invention

The present invention relates to a casement window, and more particularly to a casement window with multi-angle locking window sash which has a multi-angle locking function.

2. Description of Related Arts

In order to guard against theft, people usually close and lock the housing windows while going out or sleeping. Therefore, as no flowing and fresh air exists in the housing, the housing is sweltering and smelly. In order to solve this problem, anti-theft guardrails welded by steel bars appear and become popular. As the anti-theft guardrails are usually installed outside windows, people indoors can not escape from the windows when emergency situation such as fire occurs. In addition, the anti-theft guardrails also constitute a fire barrier and cause a lot of trouble to fire services. Further, since casement windows generally do not include a locking device, the window sashes are easy to be opened or closed violently by strong wind to cause dangers.

Due to significant side effects existing in installing the anti-theft guardrails, people utilize various alarm devices to guard against theft. Currently, the most widely-used alarm device by people is a pyroelectric infrared detector installed on the windows. When someone is invading, the pyroelectric infrared detector detects infrared thermal given off by human body and generates an alarming signal. However, the device is easy to be affected by changes of external factors such as environment, climate and pets and generates false alarms, which has a serious impact on the normally daily life of people.

SUMMARY OF THE PRESENT INVENTION

An object of the present invention is to provide a multi-angle locking window sash, which achieves a function that the window sash is capable of being opened at any angle and positioned at the angle by providing a locking mechanism between the window frame and the window sash, so as to overcome defects existing in conventional casement windows.

Technical solution to realize the present invention is following.

A casement window with multi-angle locking sash, comprises a window frame and a window sash, wherein the window sash accomplishes connecting with the window frame, and opening or closing by a window hinge mechanism and a locking mechanism, and the window sash is capable of locking at any opening or closing angle with the window frame, wherein:

the window hinge mechanism comprises a quadrilateral link mechanism, a movable sliding block, a gear and a hinge base, wherein the hinge base is fixed on the window frame, a concave sliding groove is provided on the hinge base, the movable sliding block is provided in the concave sliding groove, a wheel axle is provided on the movable sliding block, and a gear is provided on the wheel axle, wherein the quadrilateral link mechanism comprises a stationary swing rod, a movable swing rod, a link rod and a movable rod, wherein a first end of the stationary swing rod is hinged on the hinge base, a second end of the stationary swing rod is hinged on the movable rod, a first end of the link rod and a first end of the movable swing rod are hinged with the movable sliding block, a second end of the movable swing rod is hinged on the movable rod, a second end of the link rod is hinged with the stationary swing rod, wherein the movable rod is fixed with the window sash;

the locking mechanism comprises a screw rod, an axial plane is provided on the screw rod, a screw thread is provided on a circumferential surface of the screw rod, two ends of the screw rod are respectively hinged on the hinge base via a stationary base, the screw rod accomplishes locking the window sash by engaging the screw thread with the gear on the movable sliding block, and the screw rod accomplishes opening or closing the window sash by rotating the axial plane to correspond to the gear on the movable sliding block.

The technical solution further comprises the following.

Helical teeth are provided on the gear of the movable sliding block, a number of the helical teeth are the same with a modulus of the screw thread on the screw rod, and springs are respectively provided between the two ends of the screw rod and the stationary base.

A rotating wrench for rotating the screw rod is provided on the screw rod.

A first end of the screw rod is connected with a micro-switch, the micro-switch is connected with an alarming circuit, a buzzer, a reed switch and an output terminal block are provided on the alarming circuit.

The alarming circuit comprises a solar panel, a high-capacity rechargeable capacitor or a high-capacity rechargeable battery, the micro-switch, an output terminal block of alarming signal, a reed switch and the buzzer, wherein the solar panel is connected with the high-capacity rechargeable capacitor or the high-capacity rechargeable battery to serve as a supplementary power, an output of a power is in series connection with the buzzer and connected with the micro-switch, the micro-switch not only turns the buzzer on but connects the output terminal block and the reed switch as well. The reed switch is connected in parallel with the output terminal block, so as to process inductive output when the window sash is completely closed.

Beneficial effects of the present invention are following. The casement window with multi-angle locking sash according to a preferred embodiment of the present invention is capable of locking at any angle while opening by a mechanical structure, so as to prevent dangers caused by self-opening or closing violently when strong wind appears. Further, the casement window with multi-angle locking sash simultaneously has an alarming function as well. The casement window with multi-angle locking sash has characteristics of simple in structure, low in cost, convenient to install and use, and provides high safety.

Figure 1:
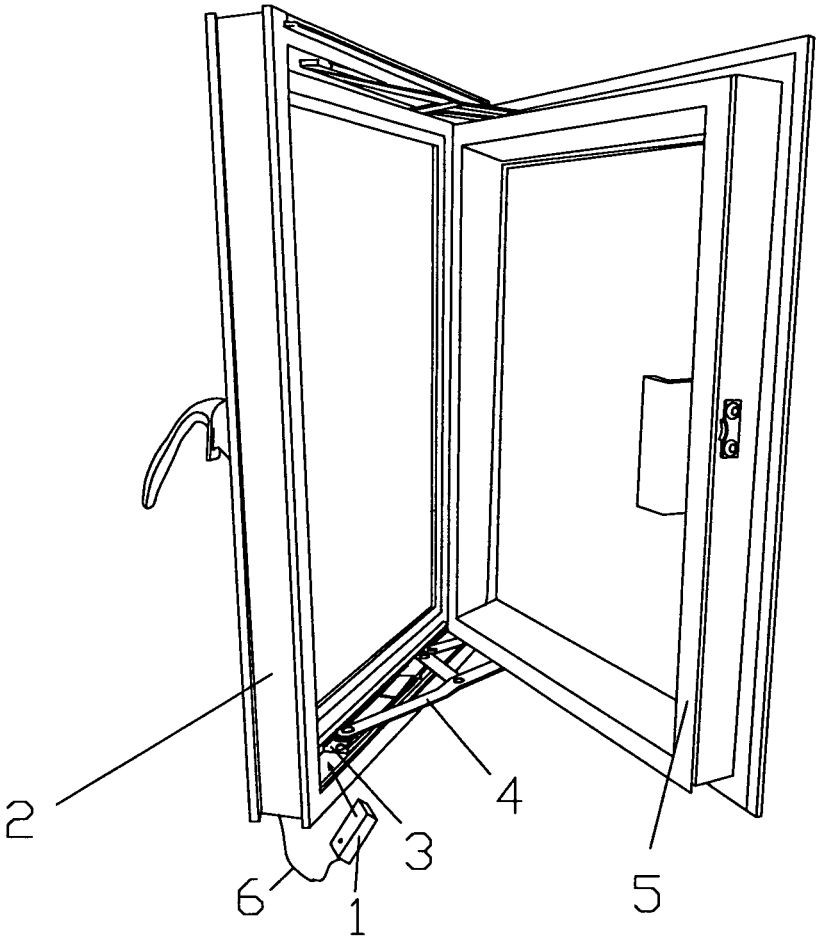
FIG. 1 is an overall structure sketch view according to a preferred embodiment of the present invention.

Reference numbers of elements in the drawings: 1-alarm, 11-buzzer, 12-rechargeable battery, 13-solar panel, 14-micro-switch, 2-window frame, 3-hinge base, 31-mounting hole, 32-inner-flanging, 33-concave sliding groove, 4-link mechanism, 41-movable swing rod, 15-alarming signal terminal block, 16-reed switch, 42-link rod, 43-stationary swing rod, 44-movable rod, 5-window sash, 6-conducting wire, 7-locking mechanism, 71-screw rod contact, 72-spring, 73-connecting hole, 74-fixing base, 75-screw rod, 76-rotating wrench, 77-screw thread, 78-axial plane, 8-wheel axle, 9-gear, 10-movable sliding block.

DETAILED DESCRIPTION OF THE PREFERRED EMBODIMENT

Combined with accompany drawings, further description of the present invention is illustrated as following.

Referring to FIG. 1 of the drawings, the casement window according to a first embodiment of the present invention consists of a window frame 2, a window sash 5, a hinge base 3, a link rod structure 4, a locking mechanism 7 and an alarm 1, wherein the hinge base 3 and the link mechanism 4 connects the window frame 2 with the window sash 5, wherein the hinge base 3 is fixed on the window frame 2, the link mechanism 4 are respectively connected with the window sash 5 and the hinge base 3, the locking mechanism 7 is connected with the alarm 1.

Figure 2:
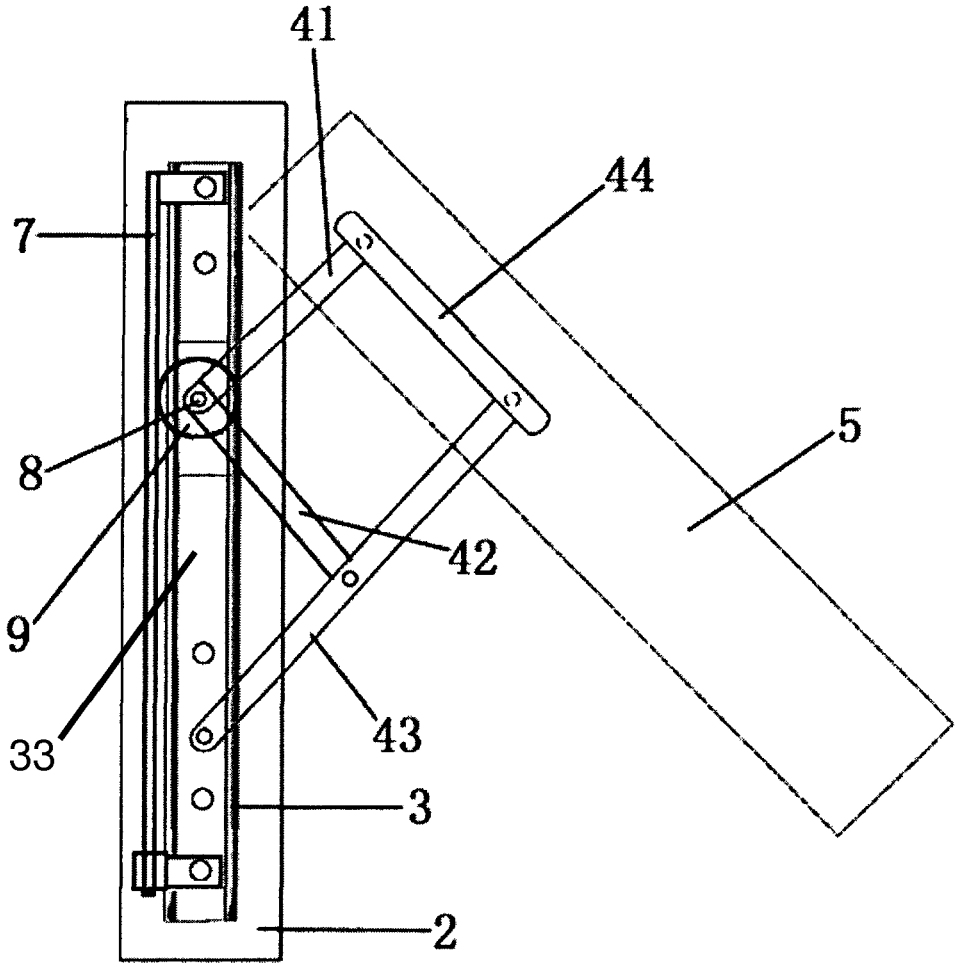
FIG. 2 is a partial sketch view of the FIG. 1, showing connection relationships and position relationships of a window sash, a window frame, a window hinge mechanism and a locking mechanism.
Figure 3:
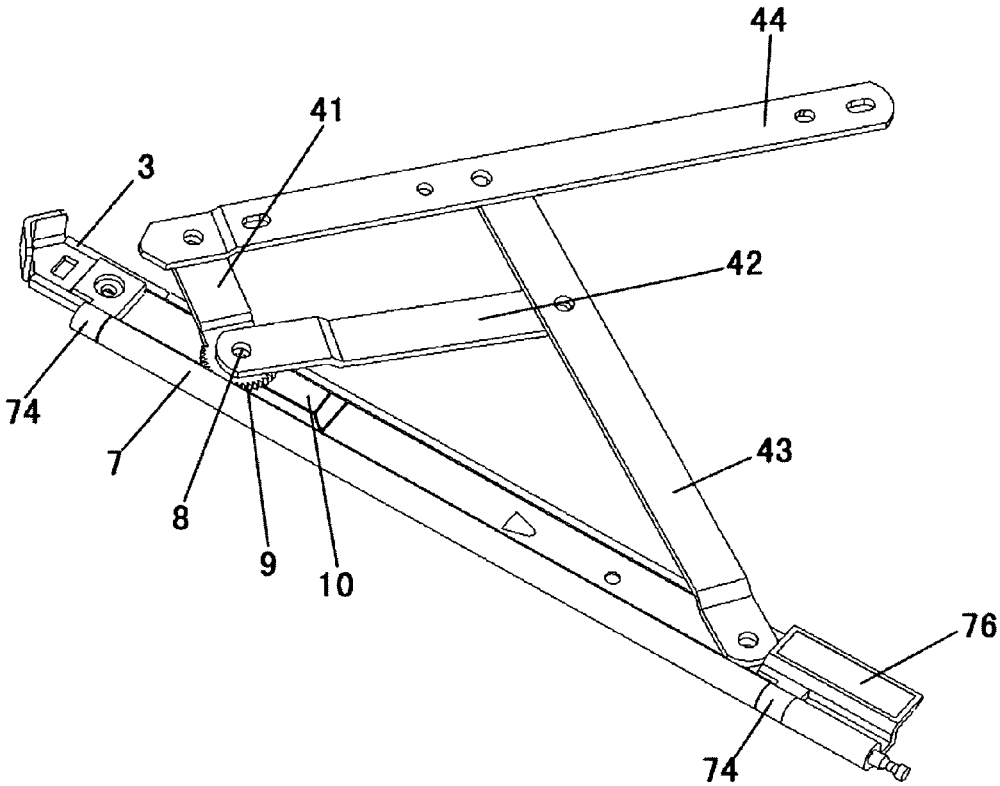
FIG. 3 is a structure sketch view of a hinge base in the FIG. 2.

Referring to FIG. 2 of the drawings, the hinge base 3 is fixed on the window frame 2, a concave sliding groove 33 is provided on the hinge base 3, a movable sliding block 10 is provided in the concave sliding groove 33, a wheel axle 8 is provided on the movable sliding block 10, and a gear 9 is provided on the wheel axle 8;

wherein the quadrilateral link mechanism 4 consists of a stationary swing rod 43, a movable swing rod 41, a link rod 42 and a movable rod 44, wherein a first end of the stationary swing rod 43 is hinged on the hinge base 3, a second end of the stationary swing rod 43 is hinged on the movable rod 44, a first end of the link rod 42 and a first end of the movable swing rod 41 are hinged with the wheel axle 8 of the movable sliding block 10, a second end of the movable swing rod 41 is hinged with the movable rod 44, a second end of the link rod 42 is hinged with the stationary swing rod 43, wherein the movable rod 44 is fixed with the window sash 5.

Figure 4:
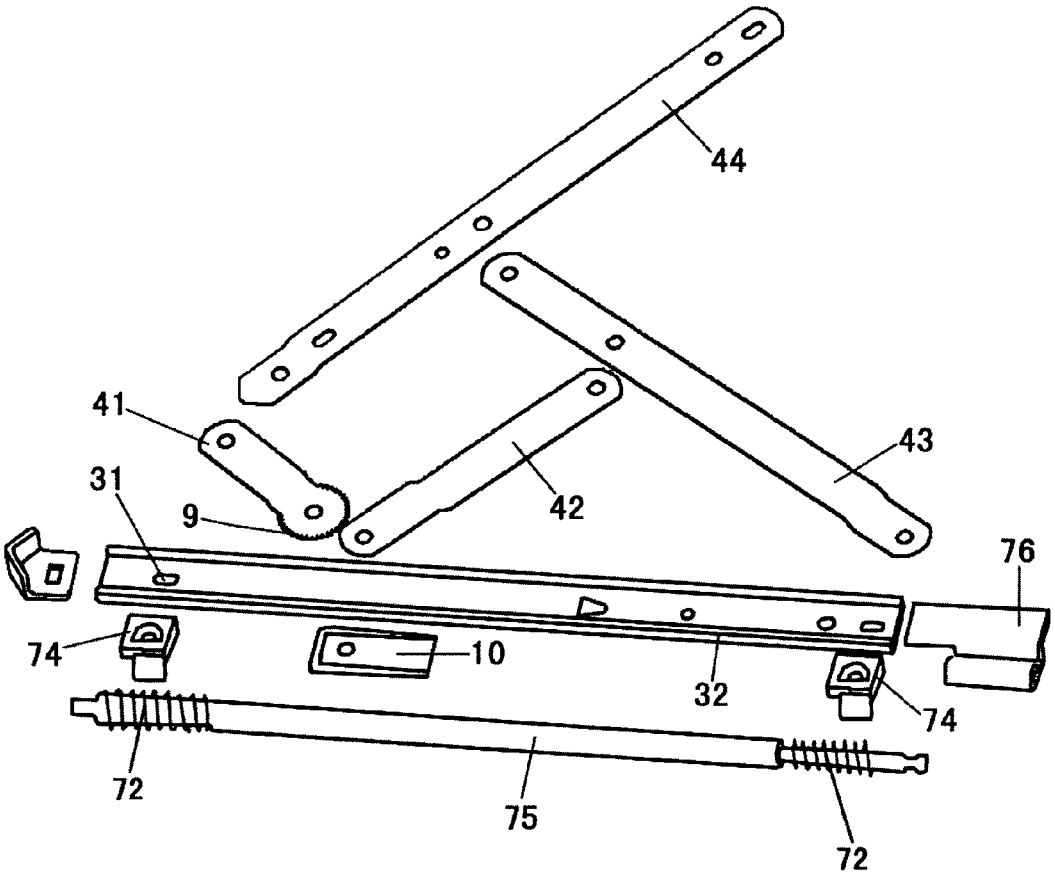
FIG. 4 is an assembly and exploded sketch view of the hinge base in the FIG. 2.
Figure 5:
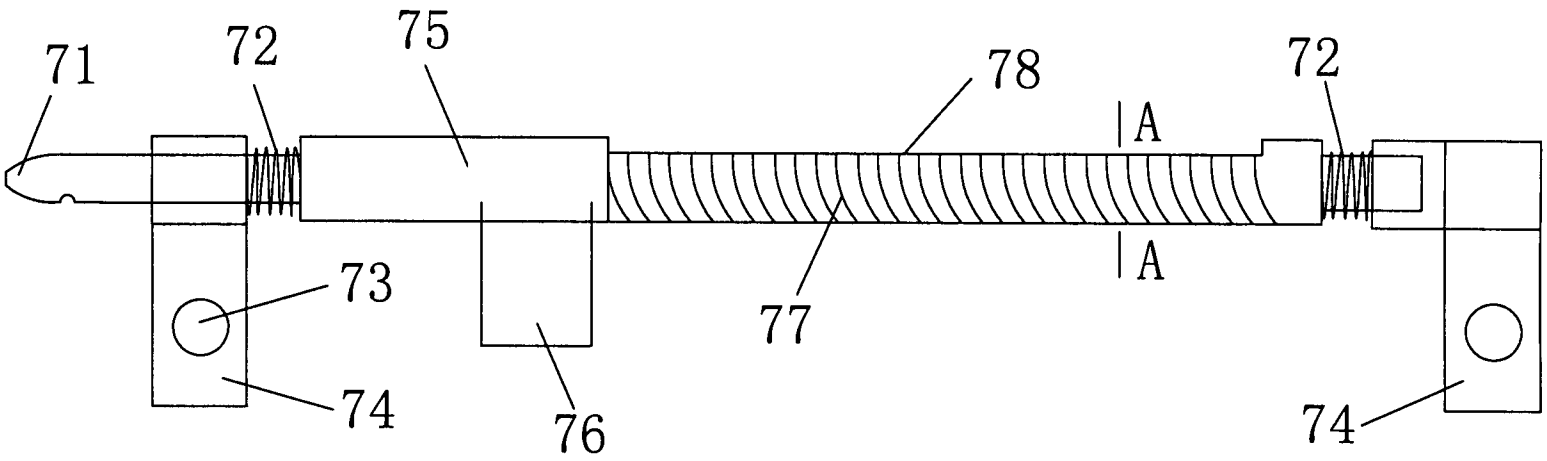
FIG. 5 is an assembly and exploded sketch view of a locking mechanism in the FIG. 2.

Referring to FIG. 4 and FIG. 5 of the drawings, the locking mechanism 7 comprises a screw rod 75, an axial plane 78 is provided on the screw rod 75, which is formed by cutting out a plane after the screw rod is processed, i.e., cutting away a first part of screw thread 77, a second part of the screw thread 77 remains on a circumferential surface of the screw rod 75, two ends of the screw rod 75 are respectively provided in stationary bases 74. A rotating wrench 76 and the screw rod 75 are capable of being rotated in the stationary bases 74. One of the stationary bases 74 is fixed on a mounting hole 31 of the hinge base 3 via a connecting hole 73. When the screw thread 77 of the screw rod 75 is engaged with the gear 9 of the movable sliding block 10, locking the window sash can be realized. After the screw rod 75 is rotated, when the axial plane 78 is corresponding to the gear 9 of the movable sliding block 10, opening or closing the window sash is accomplished.

Teeth of the gear 9 are helical teeth which have a same modulus as the screw thread 77.

Springs 72 are respectively provided between the two ends of the screw thread 75 and the stationary bases 74.

Figure 6:
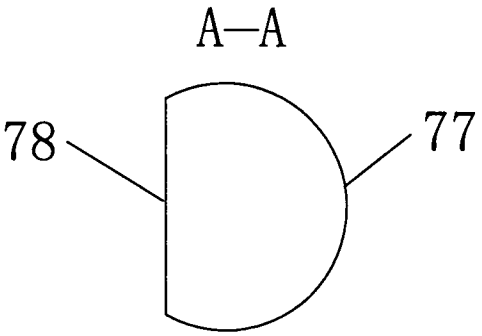
FIG. 6 is an A-A sectional view of the FIG. 5.
Figure 7:
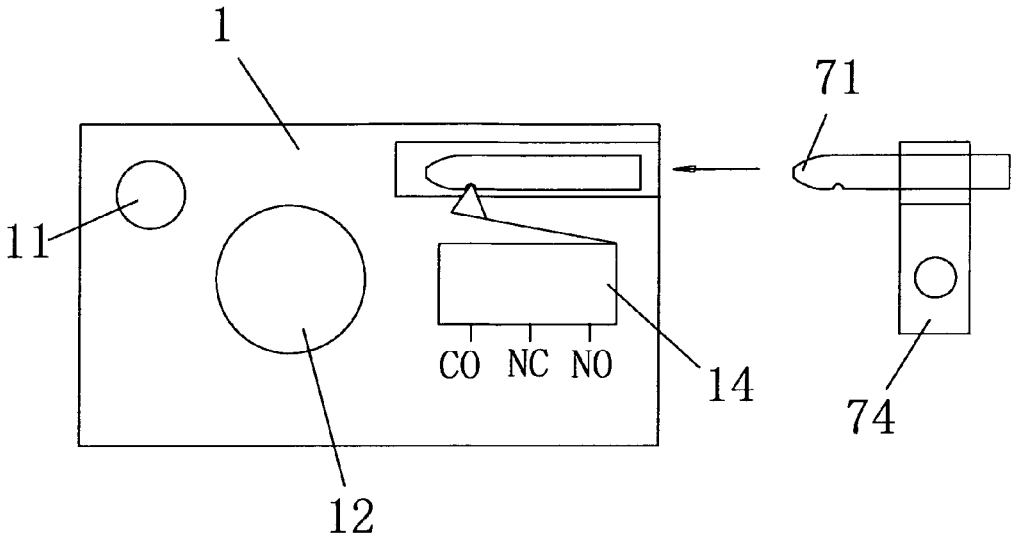
FIG. 7 is a sketch view of an alarm circuit according to a preferred embodiment of the present invention.
Figure 8:
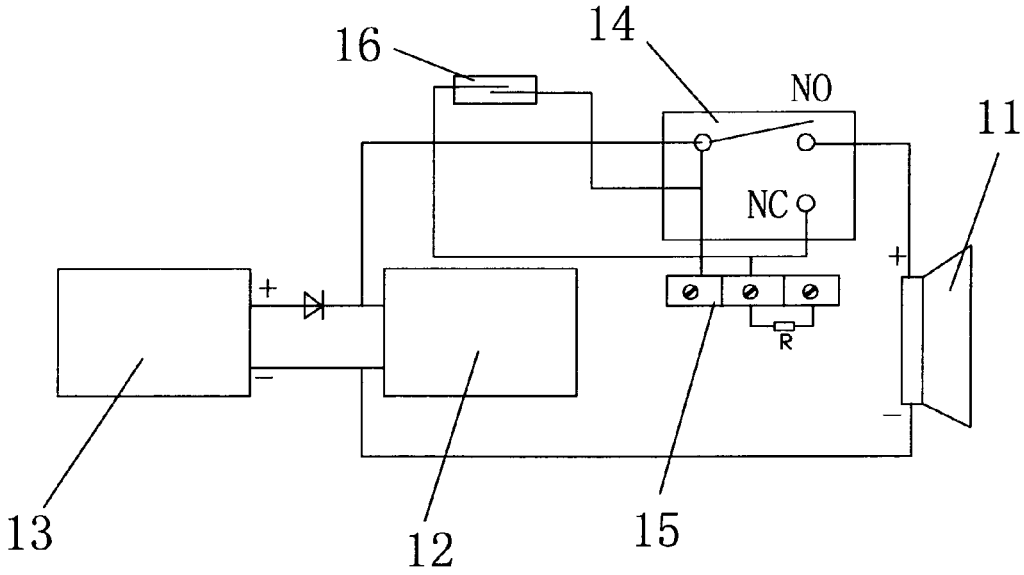
FIG. 8 is a schematic circuit diagram of the FIG. 7.

Referring to FIG. 6 and FIG. 7 of the drawings, an alarm 1 consists of a micro-switch 14, a solar panel 13, a buzzer 11 and a rechargeable battery 12, wherein a screw rod contact 71 switches a contact pressure to the micro-switch 14, the micro-switch 14 connects a circuit and an alarming signal terminal block 15, a reed switch 16 is corresponding to a magnet (not shown in the drawings) provided on a bottom of the window sash 5 and is connected in parallel with the alarming signal terminal block 15, and the buzzer 11 rings to alarm.

Working Principle

When opening or closing the window sash is required, the axial plane 78 of the screw rod 75 is rotated to correspond to the gear 9 of the movable sliding block 10, at this time, the screw rod 75 is not contact with, i.e., detached from, the gear 9, and the window sash can be opened or closed freely; when locking the window sash is required, the screw rod 75 is rotated, in such a manner that the screw thread 77 of the screw rod 75 is engaged with the gear 9, at this time, the window sash is fixed and not capable of being moved.

When the window sash is fixed, if a person forces a movement of the window sash, the screw rod 75 compresses the spring 72, the screw rod contact 71 triggers the micro-switch 14, and the circuit is connected, the alarming signal terminal block 15 is triggered, and the buzzer 11 rings to alarm; when the window sash is completely closed, the reed switch 16 is corresponding to the magnet (not shown in the drawings) provided at the bottom of the window sash and outputs a signal of a normally closed circuit.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A casement window with multi-angle locking sash, comprising a window frame and a window sash, wherein said window sash accomplishes connecting with said window frame, and opening or closing by a window hinge mechanism and a locking mechanism, and said window sash is capable of locking at any angle with said window frame, wherein:

said window hinge mechanism comprises a quadrilateral link mechanism, a movable sliding block, a gear and a hinge base, wherein said hinge base is fixed on said window frame, a concave sliding groove is provided on said hinge base, said movable sliding block is provided in said concave sliding groove, a wheel axle is provided on said movable sliding block, and said gear is provided on said wheel axle, wherein said quadrilateral link mechanism comprises a stationary swing rod, a movable swing rod, a link rod and a movable rod, wherein a first end of said stationary swing rod is hinged on said hinge base, a second end of said stationary swing rod is hinged on said movable rod, a first end of said link rod and a first end of said movable swing rod are hinged with said movable sliding block, a second end of said movable swing rod is hinged with said movable rod, a second end of said link rod is hinged with said stationary swing rod, wherein said movable rod is fixed with said window sash;

said locking mechanism comprises a screw rod, an axial plane is provided on said screw rod, a screw thread is provided on a circumferential surface of said screw rod, two ends of said screw rod are respectively hinged on said hinge base via a stationary base, said screw rod accomplishes locking said window sash by engaging said screw thread with said gear on said movable sliding block, and said screw rod accomplishes opening or closing said window sash by rotating said axial plane corresponding to said gear on said movable sliding block.

2. The casement window with multi-angle locking sash, as recited in claim 1, wherein helical teeth are provided on said gear of said movable sliding block, a number of said helical teeth is the same with a modulus of said screw thread on said screw rod.

3. The casement window with multi-angle locking sash, as recited in claim 1, wherein springs are respectively provided between said two ends of said screw rod and said stationary bases.

4. The casement window with multi-angle locking sash, as recited in claim 1, wherein a rotating wrench for rotating said screw rod is provided on said screw rod.

5. The casement window with multi-angle locking sash, as recited in claim 1, wherein a first end of said screw rod is connected with a micro-switch, said micro-switch is connected with an alarming circuit, and a buzzer is provided on said alarming circuit.

6. The casement window with multi-angle locking sash, as recited in claim 5, wherein said alarming circuit comprises a solar panel, a high-capacity rechargeable capacitor or a high-capacity rechargeable battery, said micro-switch, an output terminal block, a reed switch and said buzzer, wherein said solar panel is connected with said high-capacity rechargeable capacitor or said high-capacity rechargeable battery to serve as a supplementary power, an output of a power is in series connection with said buzzer and connected with said micro-switch, said micro-switch not only turns said buzzer on but connects said output terminal block and said reed switch as well.

* * * * *